US005896785A

United States Patent [19]

Shaw et al.

[11] Patent Number: 5,896,785

[45] **Date of Patent: *Apr. 27, 1999**

[54] AUTOMOBILE GAS CAP REMOVAL TOOL

[76] Inventors: Richard J. Shaw; Mark R. Shaw, both of W289 N7882 Park Dr., Hartland, Wis. 53029

[ * ] Notice: This patent issued on a continued prosecution application filed under 37 CFR 1.53(d), and is subject to the twenty year patent term provisions of 35 U.S.C. 154(a)(2).

[21] Appl. No.: 08/575,830

[22] Filed: Dec. 20, 1995

[51] Int. Cl.[6] ..... B67B 7/14

[52] U.S. Cl. ..... 81/3.4; 81/121.1

[58] Field of Search ..... 81/3.07, 3.09, 81/3.4, 125, 121.1, 124.2; 87/124.6, 124.7

[56] References Cited

U.S. PATENT DOCUMENTS

| | | | |
|---|---|---|---|
| D. 261,606 | 11/1981 | La Fargo et al. | 81/124.2 |
| 342,824 | 6/1886 | Clark | 81/124.2 |
| 1,188,305 | 6/1916 | Noerteman | 81/121.1 |
| 2,718,801 | 9/1955 | Finley | 81/3.41 |
| 3,037,408 | 6/1962 | Rives et al. | 81/3.42 |
| 3,048,067 | 8/1962 | Miles et al. | 81/3.4 |
| 3,121,355 | 2/1964 | Morel et al. | 81/3.4 |
| 3,186,263 | 6/1965 | Grote | 81/3.1 |
| 4,033,205 | 7/1977 | Hoskins | 81/3.42 |
| 4,469,235 | 9/1984 | Parker | 215/295 |
| 4,836,065 | 6/1989 | Setliff | 81/124.2 |
| 4,846,025 | 7/1989 | Keller | 81/3.09 |
| 5,439,338 | 8/1995 | Rosenberg | 81/124.2 |

*Primary Examiner*—David A. Scherbel
*Assistant Examiner*—Joni B. Danganan
*Attorney, Agent, or Firm*—Robert T. Johnson

[57] ABSTRACT

Automobile gas cap removal tool, formed of plastic or aluminum and the tool has a bell shape with channels formed by wall segments on the inside of the bell shaped segment and a pillar or shaft extending from the top of the bell segment to a handle mounted on the opposite end of the pillar extending from the bell segment.

4 Claims, 2 Drawing Sheets

AUTOMOBILE GAS CAP REMOVAL TOOL

SUMMARY OF INVENTION

Automobile gas cap removal, particularly of the new cars, presents a problem of removal due to difficulty of a grip on the cap ridge. To overcome the problem this present invention discloses and claims a tool molded of a plastic compound, or die cast metal molding such as aluminum for fitting over the automobile gas cap to provide a grip for easier turning of the gas cap for unscrewing, which is of great aid to those having arthritis or the elderly having difficulty in unscrewing the gas cap. This tool is not part of the automobile gas cap but is used as a tool, and after use is removed from the cap.

OBJECTS OF THIS INVENTION

An object of this invention is to disclose as an article of manufacture, an automobile gas cap removal tool having a handle and a bell shaped housing and a shaft connecting the handle to the housing and channel walls inside of the bell shaped housing and extending downward for a distance less than the height of the bell shaped housing.

Another object of this invention is to disclose as an article of manufacture an automobile gas cap removal tool having two channels inside of a bell shaped housing and the channels crossing at their centers and the channels are bounded by the channel walls.

A further object of this invention is to disclose as an article of manufacture, an automobile gas cap removal tool of two channels inside of the bell shaped housing and the channels crossing at their centers at an angle of 90° to each other and the channels bounded by the channel walls, and the bell shaped housing having an open end diameter exceeding the diameter of the gas cap and a ridge of the gas cap more narrow than the channels of the gas cap removal tool, and the ridge of the gas cap fitting into one of the channels of the automobile gas cap removal tool on placing the gas cap removal tool on the automobile gas cap.

Further disclosure is made of an automobile gas cap removal tool molded of an aluminum die casting or molded of a plastic compound selected from the group consisting of polypropylene, polyethylene, polyvinyl, polyurethane, polystyrene or nylon.

PRIOR ART

U.S. Pat. No. 2,718,801 to Finley for DECAPPING OF CONTAINERS. This patent discloses a tool for removing caps from milk bottles and comprises a chuck with dogs to snap inwardly to engage the cap.

U.S. Pat. No. 3,037,408 to Rives et al for RADIATOR CAP REMOVAL. Disclosure is made of a device for removing caps from automobile radiators and similar pressurized fluid handling means and includes adjustable jaws for clamping on the radiator cap by means of a tension spring.

U.S. Pat. No. 3,186,263 to Grote for RADIATOR CAP REMOVER. Disclosure is made of a tool for radiator cap removal and includes a resilient member requiring a slight expansion for holding the cap on removal.

U.S. Pat. No. 4,033,205 to Hoskins for WRENCH FOR CONTAINER CLOSURES. This tool includes grippers for the caps to facilitate unscrewing.

U.S. Pat. No. 4,469,235 to Parker for CLOSURE WITH UPWARDLY EXTENDING TABS. This patent discloses a jar cap with a plurality of tabs extending upward.

U.S. Pat. No. 4,846,025 to Keller et al for RADIATOR TOOL CAP. Disclosure is made of a radiator cap removal tool wherein the cap lodges within the recess of the tool.

U.S. Pat. No. 4,836,065 to Setliff for RADIATOR CAP REMOVAL TOOL. This radiator cap removing tool includes a pressure relief valve.

Figure 1:
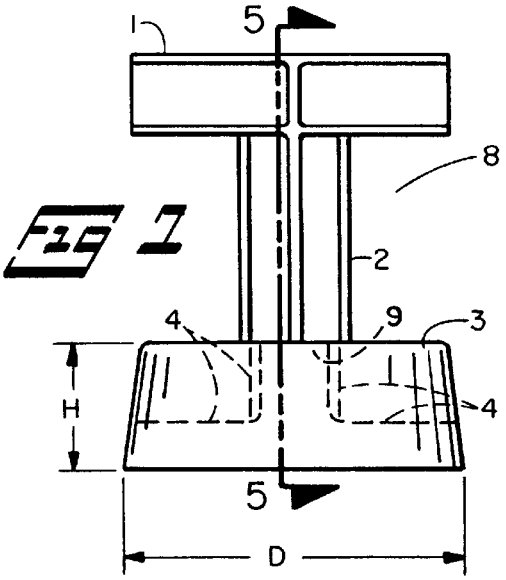
FIG. 1—Elevational view of front of Automobile Gas Cap Removal Tool.
Figure 2:
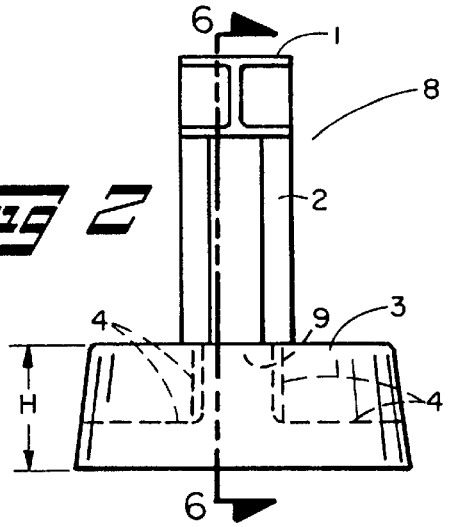
FIG. 2—Elevational view of side of Automobile Gas Cap Removal Tool.

It is to be pointed out that on referring to FIG. 1 that the opposite side is a mirror image of the side shown and on referring to FIG. 2, the opposite side is a mirror image of the side shown.

LEGENDS OF DRAWINGS

1—Handle.
2—Shaft or pillar connecting handle to housing.
3—Housing.
4—Channel walls.
5—Automobile gas cap.
6—Ridge on automobile gas cap.
7, 7'—Channels
8—Automobile gas cap removal tool
9—Inside upper surface of housing.
H—Height of bell shaped housing.
D—Diameter of bottom or open end of bell shaped housing.

DETAILED DESCRIPTION OF INVENTION

Removing a gas cap from an automobile gas tank many times presents a problem in the initial ratcheting on unscrewing the gas cap.

To solve this critical problem there is disclosed and claimed a special tool to solve this gas cap removal problem.

Figure 4:
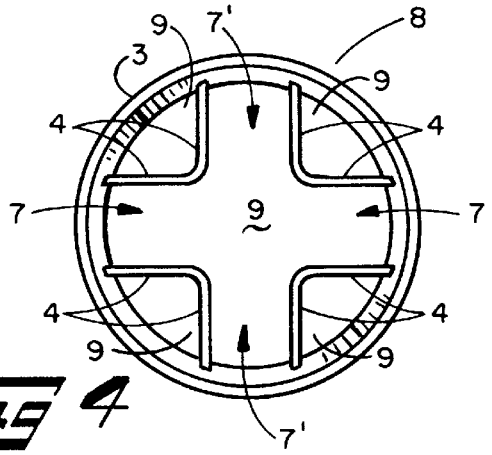
FIG. 4—Plan view of bottom of Automobile Gas Cap Removal tool.

Referring now to the drawings, FIG. 1 is an elevational view of the front of the automobile gas cap removal tool showing the handle 1, and shaft or pillar 2, connecting the handle 1 to the housing 3. The housing 3 is similar to a bell, with the opening directed downward and channel walls 4, inside of the housing 3 and these channel walls 4 as shown in FIG. 4, arranged to provide two grooves 7 and 7' each at 90° from the other.

Figure 7:
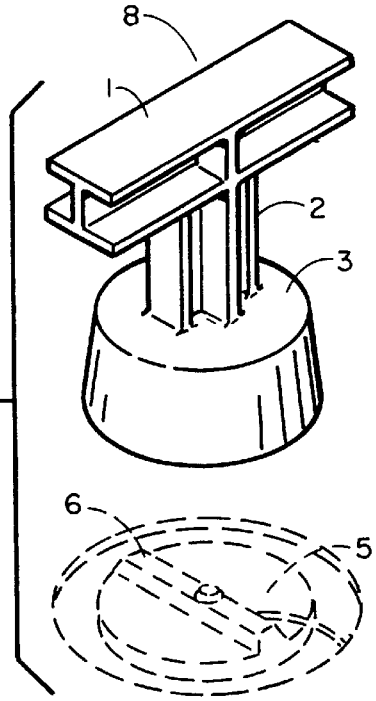
FIG. 7—Perspective elevational view of Automobile Gas Cap Removal Tool in relation to automobile gas cap.

The grooves 7, and 7' are of such width to fit over and straddle the ridge 6 on the automobile gas cap 5, (see FIG. 7). Ridge 6 is more narrow than grooves 7, 7'.

FIGS. 1 and 2 elevational views show the channel walls 4 as shadow lines of the housing 3.

Figure 3:
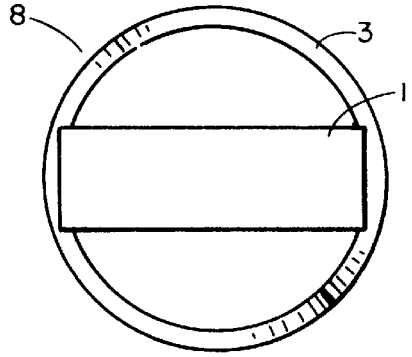
FIG. 3—Plan view of top of Automobile Gas Cap Removal Tool.

FIG. 3 is a top plan view showing the handle 1 and housing 3.

Figure 5:
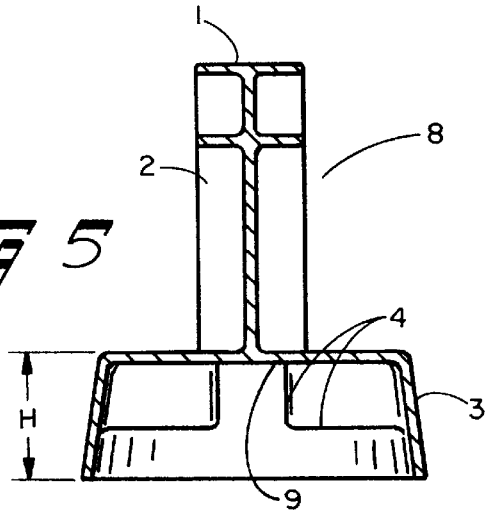
FIG. 5—Cross section elevational view of side of Automobile Gas Cap Removal Tool.

FIG. 5 is a sectional elevational side view of FIG. 2 showing the handle 1, shaft or pillar 2, connecting the handle 1 to the housing 3, and the channel walls 4, for grooves or channels 7 and 7'.

Figure 6:
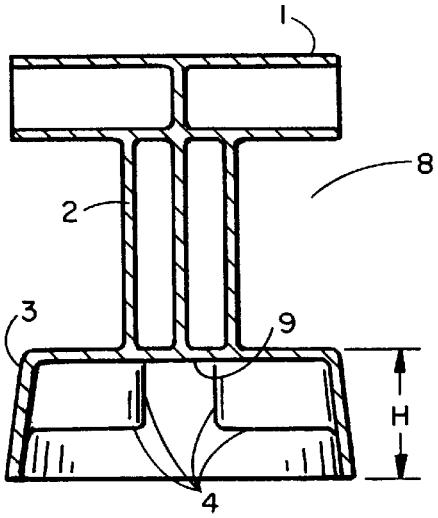
FIG. 6—Cross section elevational view of front of Automobile Gas Cap Removal Tool.

FIG. 6 is a sectional elevational side view of FIG. 1 showing the handle 1, shaft or pillar 2, connecting the handle 1 to the housing 3, and the channel walls 4, for grooves or channels 7 and 7'.

Figure 8:
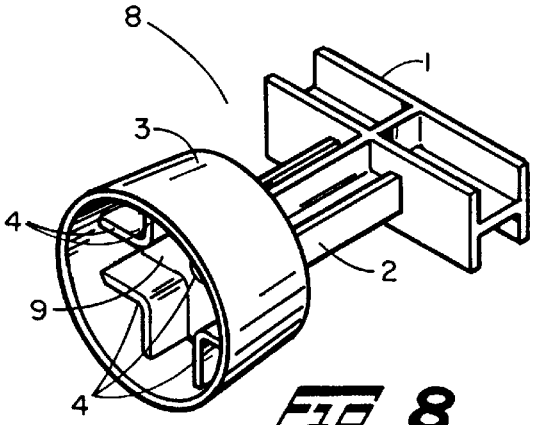
FIG. 8—Perspective view from bottom of Automobile Gas Cap Removal tool.

Referring now to FIG. 8 which is a perspective view of the housing 3 from the bottom to illustrate the recessed channel walls 4, such that the housing 3 can be centered over the gas cap cover 5 and gas cap ridge 6 on the automobile gas cap 5 enters or fits into a groove 7 or 7' and the tool 8 is then turned counterclockwise for removal of the gas cap 5.

A further description of this invention includes an automobile gas cap removal tool 8, (see FIGS. 1, 2, 7 and 8) having a handle 1, a bell shaped housing 3, and a shaft 2, connecting the handle 1 to the housing 3, and channel walls 4 (see FIGS. 1, 2, 4, 5, 6 and 8) inside of the bell shaped housing 3, and extending downward for a distance less than the height H (see FIGS. 1 and 2) of the bell shaped housing 3.

Referring now to FIGS. 1 and 2 the channel walls 4 are shown in phantom lines as extending downward less than the height of the bell shaped housing 3. On referring now to FIGS. 5 and 6 showing elevational cross section views of the automobile gas cap removal tool 8 and channel walls 4 in relation to the height H of the housing 3.

Further description is had by referring to FIGS. 4 and 8, of the automobile gas cap removal tool 8 showing two channels 7, 7' inside of the bell shaped housing 3 and the two channels 7, 7' crossing at their centers and the channels are bounded by the channel walls 4 extending downward from the inside upper surface 9 of the housing 3 and these channel walls 4 extending only part way downward of the height H of the bell shaped housing 3.

To further describe this invention of an automobile gas cap removal tool 8, reference is made to FIGS. 4 and 8, showing of the two channels 7, 7' inside of the bell shaped housing 3, and the channels 7, 7' crossing at their centers at an angle of 90° to each other, and the channels 7, 7' bounded by the channel walls 4, and the bell shaped housing 3 having an open end diameter D exceeding the diameter of the gas cap 5 and a ridge 6 of the gas cap 5 more narrow than the channels 7, 7' of the gas cap removal tool 8, so that on placing the tool 8 on the gas cap 5 the ridge 6 of the gas cap 5 will fit into either channel 7 or 7' for unscrewing the automobile gas cap 5.

Referring to FIG. 3 which is a top plan view of the automobile gas cap tool 8 placed in position for unscrewing the gas cap 5 with ridge 6 fitting in either channel 7 or 7'.

The automobile gas cap removal tool as described above, can be made of aluminum metal die casting or molded plastic compound selected from the group consisting of polypropylene, polyethylene, polyvinyl, polyurethane, polystyrene or nylon.

The above detailed description of the invention describes the preferred embodiment however, as an alternate the automobile gas cap removal tool 8 with a handle 1, and a bell shaped housing 3, and a shaft 2 or pillar connecting the handle 1 to the housing 3, and channel walls 4, to provide one channel 7 in the bell shaped housing 3. This second embodiment thus has only one channel 7, in contrast to the two channels 7, 7' in the preferred embodiment, with both embodiments having channel walls 4 extending downward in the housing 3 for a distance less than the height H of the bell shaped housing 3.

Figure 9:
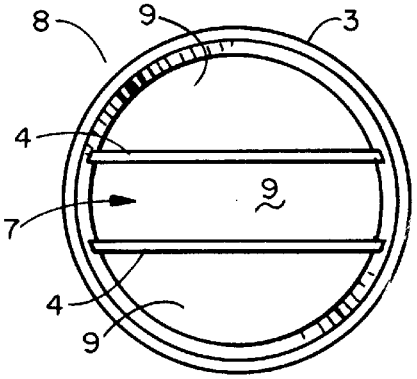
FIG. 9—Plan view of bottom of Automobile Gas Cap Removal Tool showing alternate or second embodiment of one channel.

Reference is now made to FIG. 9, to show this alternate or second embodiment.

The automobile gas cap removal tool 8 may have at least one channel and may include a plurality of two or more channels inside of the bell shaped housing.

Having described our invention we claim:

1. Automobile gas cap removal tool, wherein the improvement comprises;

a—a handle and shaft attached to a bell shaped housing and, b—two channels bounded by channel walls inside of said bell shaped housing and, c—said channel walls extending downward for a distance less than the height inside of said bell shaped housing and, d—said two channels crossing at their centers at an angle of 90° to each other and, e—said automobile gas cap removal tool molded of plastic selected from the group consisting of polypropylene, polyethylene, polyvinyl, polyurethane, polystyrene, or nylon.

2. An automobile gas cap removal tool comprising;

a—a handle and, b—a bell shaped housing and channel walls inside of said bell shaped housing and c—said channel walls extending downward for a distance less than the height of said bell shaped housing and, d—two channels inside of said bell shaped housing and, e—said channels crossing at their centers and said channels bounded by said channel walls and, f—said channels crossing at their centers at an angle of 90° to each other.

3. The automobile gas cap removal tool of claim 2, wherein further improvement comprises said automobile gas cap removal tool molded of die cast aluminum.

4. An automobile gas cap removal tool wherein further improvement comprises;

a—a handle and, b—a bell shaped housing and, c—a shaft connecting said handle to said bell shaped housing and, d—channel walls inside of said bell shaped housing and, e—said channel walls extending downward for a distance less than the height of said bell shaped housing and, f—two channels inside of said bell shaped housing and, g—said channels crossing at their centers and, h—said channels bounded by said channel walls, and i—said channels crossing at their centers at an angle of 90° to each other and, j—said automobile gas cap removal tool molded of plastic selected from the group consisting of polypropylene, polyethylene, polyvinyl, polyurethane, polystyrene or nylon.

* * * * *